US009981772B2

(12) United States Patent
Huang et al.

(10) Patent No.: US 9,981,772 B2
(45) Date of Patent: May 29, 2018

(54) RIGID CONTAINER FLOOR AND CONTAINER WITH SAME

(71) Applicants: NANTONG CIMC-SPECIAL TRANSPORTATION EQUIPMENT MANUFACTURE CO., LTD., Nantong (CN); CHINA INTERNATIONAL MARINE CONTAINERS (GROUP) LTD., Shenzhen (CN); CIMC CONTAINERS HOLDING COMPANY LTD., Dongguan (CN)

(72) Inventors: Zhijun Huang, Nantong (CN); Xinlin Lu, Nantong (CN)

(73) Assignees: Nantong CIMC-Special Transportation Equipment Manufacture Co., Ltd., Nantong (CN); China International Marine Containers (Group) Ltd., Shenzhen (CN); CIMC Containers Holding Company Ltd., Dongguan (CN)

( * ) Notice: Subject to any disclaimer, the term of this patent is extended or adjusted under 35 U.S.C. 154(b) by 0 days. days.

(21) Appl. No.: 15/323,550

(22) PCT Filed: Jun. 9, 2015

(86) PCT No.: PCT/CN2015/081105
§ 371 (c)(1),
(2) Date: Jan. 3, 2017

(87) PCT Pub. No.: WO2016/000516
PCT Pub. Date: Jan. 7, 2016

(65) Prior Publication Data

US 2017/0144794 A1 May 25, 2017

(30) Foreign Application Priority Data

Jul. 2, 2014 (CN) ..... 2014 1 0313542
Nov. 11, 2014 (CN) ..... 2014 1 0632210

(51) Int. Cl.
*B65D 6/38* (2006.01)

(52) U.S. Cl.
CPC ..... *B65D 11/24* (2013.01)

(58) Field of Classification Search
CPC ..... B65D 1/0261; B65D 11/24; B65D 7/00
(Continued)

(56) References Cited

U.S. PATENT DOCUMENTS 994,098 A * 5/1911 Kauffmann ..... B65D 7/36 220/607
5,720,930 A * 2/1998 Bean ..... A61L 2/26 206/370

(Continued)

FOREIGN PATENT DOCUMENTS

CN 2590961 Y 12/2003
CN 203714504 U 7/2014

(Continued)

OTHER PUBLICATIONS

PCT International Search Report for application PCT/CN2015/081105 dated Sep. 11, 2015.
PCT Written Opinion of the International Searching Authority for application PCT/CN2015/081105 dated Sep. 11, 2015.

(Continued)

*Primary Examiner* — King M Chu
(74) *Attorney, Agent, or Firm* — Alston & Bird LLP

(57) ABSTRACT

A rigid container floor and a container with the same floor are disclosed. A plurality of blind waves (1) are provided in parallel on the rigid container floor (10), and upwards protrude out of the upper surface of the rigid container floor (10). The blind wave (1) includes a first edge and a second edge, with the length of the first edge longer than the length (Continued)

of the second edge. The parts between the first edges of the adjacent blind waves and the parts between the first edges of the blind waves and the first edges of the rigid container floor (10) are flat plate structures. The flat plate structures are connected to the blind waves (1) through waved connecting plates, and the parts between the second edges of the blind waves (1) and the second edges of the rigid container floor (10) are connected to the blind waves (1) through waved connecting plates. The multiple blind waves (1) provided in parallel can increase the strength and reduce the assembly deformation. And the edge structure of the rigid container floor (10) can be automatically and continuously welded with a container underframe because the edge parts of the rigid container floor (10) are connected to the blind waves through the waved connecting plates.

20 Claims, 3 Drawing Sheets

(58) Field of Classification Search
USPC ..... 220/600, 607, 623
See application file for complete search history.

(56) References Cited

U.S. PATENT DOCUMENTS

| | | | | |
|---|---|---|---|---|
| 7,093,722 | B2 * | 8/2006 | Grumbine | B01D 21/0012 15/264 |
| 7,540,395 | B2 * | 6/2009 | Dhellemmes | B63B 3/68 220/608 |
| 2007/0194028 | A1 * | 8/2007 | Ahn | B65D 75/004 220/607 |

FOREIGN PATENT DOCUMENTS

| | | | |
|---|---|---|---|
| DE | 3804438 | A1 | 8/1989 |
| DE | 202004013908 | U1 | 10/2004 |
| DE | 102004047551 | A1 | 5/2005 |
| EP | 1867586 | A1 | 12/2007 |
| WO | WO 1999/030989 | A1 | 6/1999 |
| WO | WO 2016/000516 | A1 | 1/2016 |

OTHER PUBLICATIONS

PCT International Preliminary Report on Patentability for application PCT/CN2015/081105 dated Jan. 3, 2017.

* cited by examiner

A-A

B-B

RIGID CONTAINER FLOOR AND CONTAINER WITH SAME

CROSS REFERENCE TO RELATED APPLICATIONS

This application is a US National Stage of PCT/CN2015/081105 filed Jun. 9, 2015, which claims priority to CN Application No. 201410313542.4 filed Jul. 2, 2014 and CN Application No. 201410632210.2 filed Nov. 11, 2014, each of which are hereby incorporated by reference.

BACKGROUND

The present invention relates to the field of containers, and particularly to a rigid container floor and the container comprising the same.

The containers have been widely used in the world as a universal means of transportation. At present, conventional containers commonly employ a wood floor as a load bearing floor, thus timber consumption is relatively high. With the shortage of the timber for the container floor, container manufacturing cost is rising. Also handling vehicles are likely to damage the wood floor when running into the container, making wood floors at a high maintenance cost. Therefore, the current container manufacturers try to use a rigid floor instead of the wood floor.

The Chinese invention patent application NO. 201320817638.5, entitled "CONTAINER WITH RIGID FLOORS" filed with SIPO, describes a rigid floor of a container with stiffeners which are provided on the floor so as to increase the strength of the floor. However, due to the existence of the stiffeners, plugs are required to seal the openwork at the overlapping parts of the bottom frame of a container. Furthermore, the rigid floor of such a structure can not fulfill the automatic welding of the container, that is, continuous welding by means of the robots. Whereas if the stiffener at the edge part of the rigid floor is to be knocked and flattened, not only workload is increased, but also the welding defect may readily occur.

SUMMARY

In this SUMMARY section, a series of simplified concepts are introduced which will get a further detailed description in the DETAILED DESCRIPTION section. The SUMMARY section of the present invention does not intend to define the critical features and the essential technical features of the claimed technical solution, nor intend to determine the protection reach of the claimed technical solution.

To solve the above problem, the present invention discloses a rigid container floor, the rigid container floor is provided thereon in parallel with a plurality of blind waves protruding upward from the upper surface of the rigid container floor, the blind wave comprises a first side and a second side with the length of the first side being greater than that of the second side, and the part of the rigid container floor between the first sides of the adjacent blind waves and the part of the rigid container floor between the first side of the blind wave and the first edge of the rigid container floor are flat plate structures, characterized in that, the flat plate structures are connected to the blind waves through wave connecting plates, and the part of the rigid container floor between the second side of the blind wave and the second edge of the rigid container floor is connected to the blind wave through the wave connecting plate.

Alternatively, the part of the rigid container floor between the second sides of the blind waves and the second edge of the rigid container floor is a flat plate structure connected to the blind waves through the wave connecting plate.

Alternatively, the wave connecting plate comprises a first connecting plate and a second connecting plate, the first side of the blind wave is connected to the flat plate structure through the first connecting plate, and the second side of the blind wave is connected to the flat plate structure through the second connecting plate.

Alternatively, the part of the rigid container floor between the second sides of the blind waves and the second edge of the rigid container floor is a curved structure connected to the blind waves through the wave connecting plate.

Alternatively, the curved structure is arc-shaped or M-shaped.

Alternatively, the wave connecting plate comprises a first connecting plate and a second connecting plate, the second side of the blind wave is connected to the curved structure through the second connecting plate, and the first side of the blind wave is connected to the flat plate structure through the first connecting plate.

Alternatively, the height, by which the curved structure protrudes upward from the upper surface of the rigid container floor, is less than the height, by which the blind wave protrudes upward from the upper surface of the rigid container floor.

Alternatively, the rigid container floor is molded integrally.

Alternatively, the blind wave is provided along the length direction of the rigid container floor.

Alternatively, the blind wave protrudes upward from the upper surface of the rigid container floor by a height of 3 to 15 mm.

Alternatively, the height of the blind wave is 3 to 10 mm.

Alternatively, the height of the blind wave is 6 to 8 mm.

Alternatively, the blind wave is in a runway-shape or rectangular.

The present invention also discloses a container, characterized in that, the container comprises the above rigid container floor.

Alternatively, the container further comprises a bottom frame, and the rigid container floor is welded, riveted or screwed to the bottom frame.

With the rigid container floor according to the present invention, a plurality of blind waves are provided in parallel on the rigid floor, thus it is possible to improve the strength of the floor, depress the assembly deformation, facilitate the cleanup and also act to prevent the shipped goods from sliding. Furthermore, due to the flat plate structure of the edge of the rigid floor, the rigid floor can satisfy the automatic production process of the container, that is to say, the flat plate structure at the edge of the rigid floor can be automatically and continuously welded to the bottom frame of the container, thus improving the production efficiency. Therefore, a lightweight container body can be obtained while improving the strength of the rigid floor.

BRIEF DESCRIPTION OF THE DRAWINGS

The drawings of the embodiments of present invention listed below are used as a part of the present invention herein for the understanding of the present invention. The drawings illustrate various embodiments of the present disclosure and its description, so as to explain the principle of the present disclosure. In the drawings.

DETAILED DESCRIPTION

The description herein below gives specific details for a thorough understanding of the present invention. However, as obvious to the skilled in this art, the present invention may be implemented without one or more of these details. Some of the technical features well known in this art are not described in other examples in order not to confuse with the embodiments of present invention.

Detailed structures are proposed in the following description for the purpose of understanding various embodiments of the present invention. Apparently, the implementation of the embodiment of present invention is not limited to special details known by the skilled in this art. The preferred embodiments of the present invention are described in detail as the following, however, the present invention can also comprise other embodiments besides these detailed descriptions.

Figure 1:
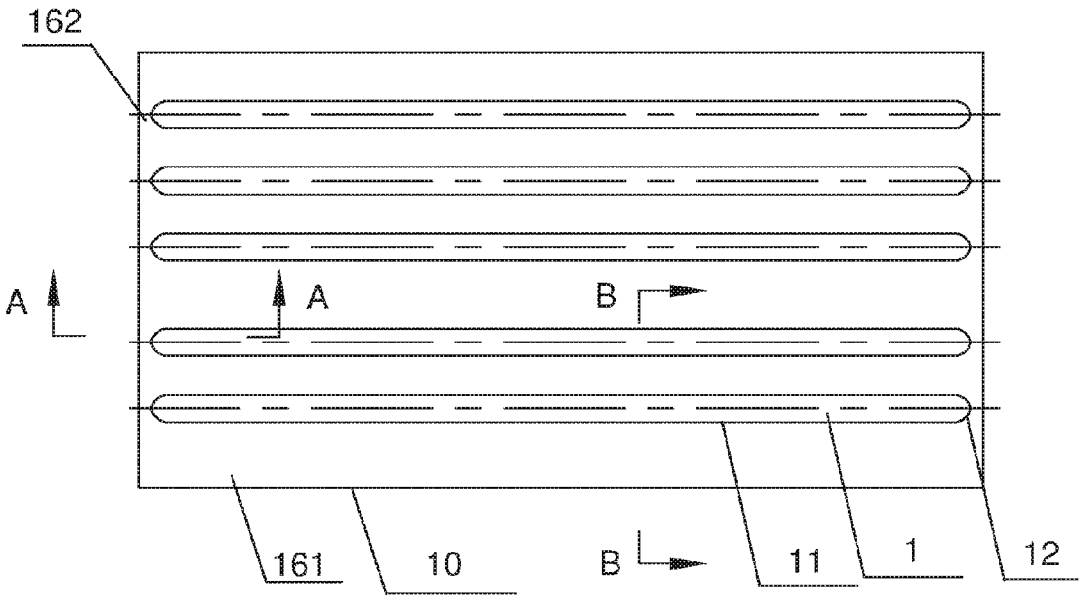
FIG. 1 is a top view of the first embodiment of the rigid container floor of the present invention.

As shown in FIG. 1, the present invention discloses a rigid container floor 10 on which a plurality of blind waves 1 are provided in parallel while protruding upward from the upper surface of the rigid container floor 10. The blind wave 1 refers to the strip bumps protruding from the upper surface of the rigid container floor 10, each blind wave has a wavy- or trapezoid-shape in their cross section, a plurality of blind waves 1 are arranged along the length direction of the container body, and a plurality of blind waves 1 are in a strip form extending along the width direction of the container body, and they can be machined in different lengths according to different container body widths of the users. The blind wave 1 comprises a first side 11 (the longer side) and a second side 12 (the shorter side), the first side 11 being longer than the second side 12.

The part of the rigid container floor 10 between the first sides 11 of two adjacent blind waves 1 is a flat plate structure, and the part of the rigid container floor 10 between the first side 11 of the blind wave 1 and the first edge of the rigid container floor 10 is also a flat plate structure, here the first edge means the border of the rigid container floor 10 in its width direction, that is to say, the edge parallel to the length direction of the rigid container floor 10. Such a flat plate structure is connected to the blind wave 1 through the wave connecting plate.

The part of the rigid container floor 10 between the second side 12 of the blind wave 1 and the second edge of the rigid container floor 10 is connected to the blind wave 1 through another blind wave connecting plate, here, the second edge means the border of the rigid container floor 10 in its length direction, that is to say, the edge parallel to the width direction of the rigid container floor 10.

The rigid container floor 10 according to the present invention is provided in parallel with a plurality of blind waves 1 thereon, thus it is possible to improve the strength of the floor, reduce the assembly deformation, facilitate the cleanup and also act to prevent the shipped goods from sliding. Further, due to the edge part of the rigid container floor in its length direction being connected to and sealed with the blind waves 1 through wave connecting plates, it's allowed to automatically and continuously weld the edge structure of the rigid container floor and bottom frame of the container, which improves the production efficiency. Therefore, a lightweight container body can be obtained while improving the strength of the rigid container floor.

According to the first embodiment of the present invention as shown in FIG. 1, the blind wave 1 is optionally provided along the length direction of the rigid container floor 10. The blind wave 1 is configured to protrude from the upper surface of the rigid container floor 10, and both ends thereof in the length direction are closed through the wave connecting plate, that is to say, the blind wave 1 doesn't run through the rigid container floor 10 in the length direction of the rigid container floor 10. This is done for the purpose of automatic welding the edge part of the rigid container floor 10, and similar operations.

Figure 2:
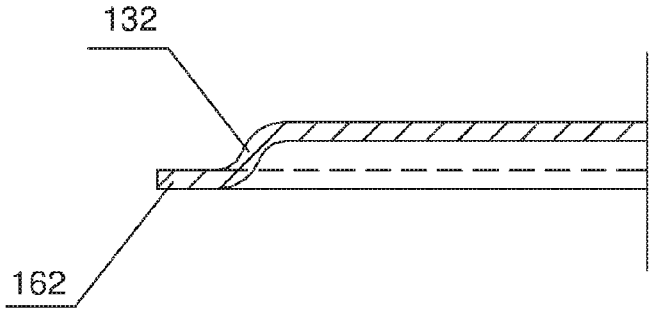
FIG. 2 is a view taken along the line A-A of FIG. 1.

Specifically, as shown in FIG. 2, the part of the rigid container floor 10 between the second side 12 of the blind wave 1 and the second edge of the rigid container floor 10 is connected to the blind wave 1 through the wave connecting plate, that is to say, both ends of the blind wave 1 in the length direction of the rigid container floor 10 are connected to the second edge parts 162 of the rigid container floor 10 through the wave connecting plate.

Figure 3:
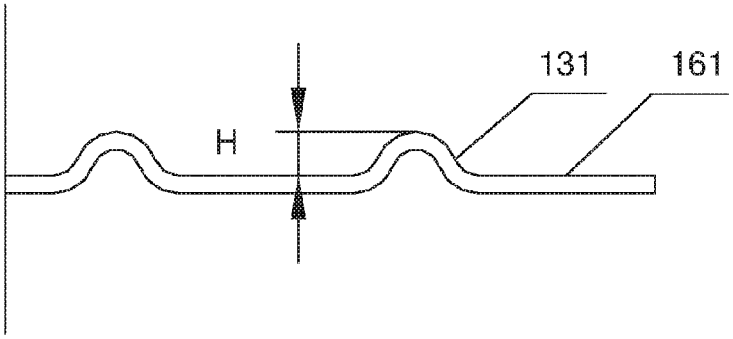
FIG. 3 is a view taken along the line B-B of FIG. 1.

Likewise, as shown in FIG. 3, the part of the rigid container floor 10 between the first side 11 of the blind wave 1 and the first edge of the rigid container floor 10 is connected to the blind wave 1 through the wave connecting plate, that is to say, one side of the blind wave 1 in the width direction of the rigid container floor 10 is connected to the first edge parts 161 of the rigid container floor 10 through another wave connecting plate.

In the embodiment as shown in FIG. 1, the wave connecting plate comprises a first connecting plate 131, and the first side 11 of the blind wave 1 is connected to the flat plate structure through the first connecting plate 131. The wave connecting plate further comprises a second connecting plate 132, and the second side 12 of the blind wave 1 is connected to the flat plate structure through the second connecting plate 132.

However, it should be understood that the edge part indicates the quadrilateral border zones on the surface of the rigid container floor 10, moreover, the distance between the end of blind wave 1 along the length direction of the rigid container floor 10 and the first edge of the rigid container floor 10 may be different from the distance between the first side 11 of the blind wave 1 closest to the second edge of the rigid container floor 10 in the width direction of the rigid container floor 10 and the second edge of the rigid container floor 10.

It can be seen from FIG. 3 that, the cross section of the rigid container floor 10 in its width direction, the plurality of blind waves 1, the flat plate structures between the adjacent blind waves land the wave connecting plates connecting the blind wave 1 to the flat plate structure conjunctly from a wave construction. The first edge part 161 of the rigid container floor 10 can satisfy the requirement for automatic welding the container, such as, continuous welding at the first edge part 161 of the rigid container floor 10 using robots.

Referring to FIG. 1 again, the blind wave 1 is alternatively provided to have a runway-shape, and both ends (i.e., the second side 12) of the blind wave 1 along the length direction of the rigid container floor 10 are circular. However, it's obvious to the skilled in this art from the present disclosure that the blind wave 1 may also be provided in other shapes, such as, rectangular etc.

Figure 4:
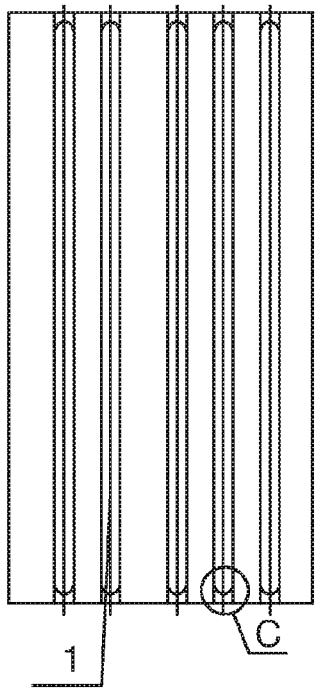
FIG. 4 is a top view of the second embodiment of the rigid container floor of the present invention.
Figure 5:
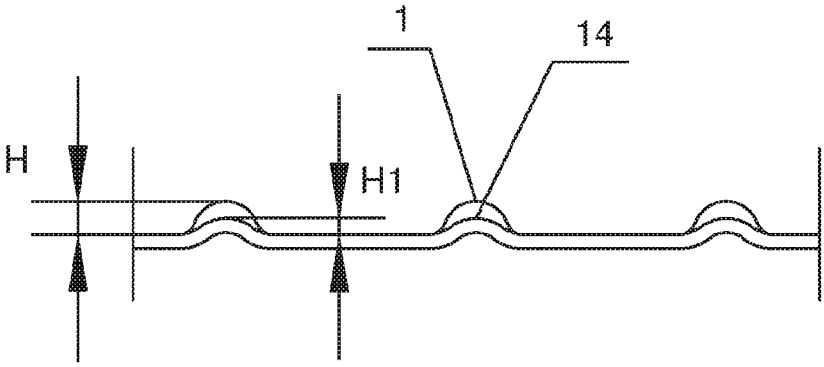
FIG. 5 is an end view of FIG. 4.
Figure 6:
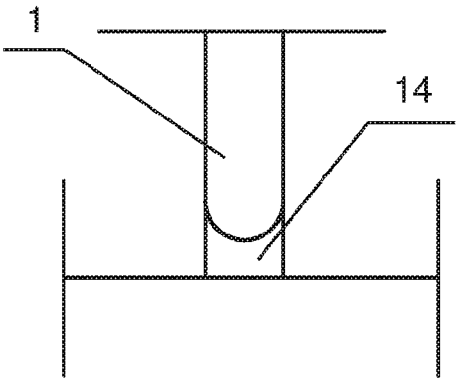
FIG. 6 is an enlarged view of the location C in FIG. 4.

FIGS. 4 to 6 illustrate the second embodiment of the present invention, which differs from the first embodiment in that the part of the rigid container floor 10 between the second side 12 of the blind wave 1 and the second edge of the rigid container floor 10 is a curved structure, that is to say, the second edge part 162 of the rigid container floor 10 is a curved structure. Usually, after the press molding of the rigid container floor 10, wave effects will occur at the second edge part 162, which has no esthetic appearance and also influences the quality of subsequent production. Therefore, when the second edge part 162 is provided in a curved structure, the stress at the second edge part 162 can be effectively reduced, so that the rigid container floor 10 will have a better overall flatness and thus the follow-up production quality can be effectively controlled.

Specifically, in the second embodiment, the curved structure is an arc-shaped structure 14 in FIG. 5, and the arc-shaped structure 14 is connected to the second side 12 of the blind wave 1 through the wave connecting plate.

Figure 7:
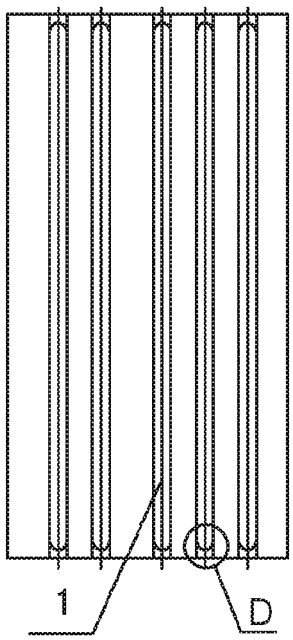
FIG. 7 is a top view of the third embodiment of the rigid container floor of the present invention.
Figure 8:
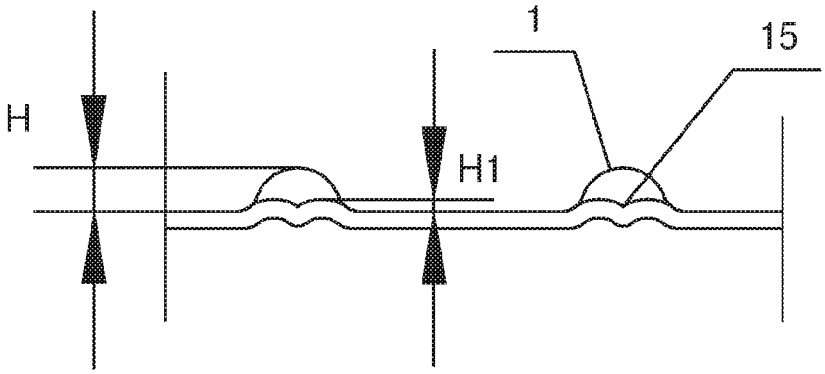
FIG. 8 is an end view of FIG. 7.
Figure 9:
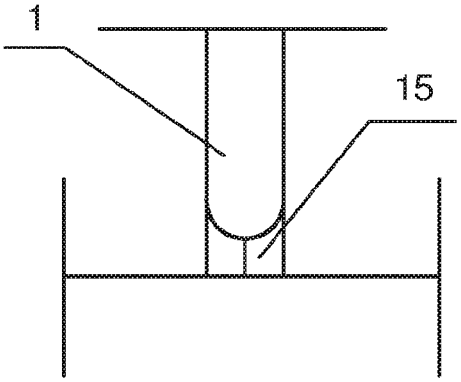
FIG. 9 is an enlarged view of the location D in FIG. 7.

FIGS. 7 to 9 illustrate the third embodiment of the present invention, which differs from the above embodiments in that the part of the rigid container floor 10 between the second side 12 of the blind wave 1 and the second edge of the rigid container floor 10 is a curved structure, that is to say, the second edge part 162 is another curved structure, specifically, this curved structure has a M-shaped curved structure 15, and the M-shaped curved structure 15 is connected to the blind wave 1 through the wave connecting plate.

Similar to the first embodiment, the wave connecting plate in the second and third embodiments may comprise a first connecting plate and a second connecting plate, the first side 11 of the blind wave 1 is connected to the flat plate structure through the first connecting plate, and the second side 12 of the blind wave 1 is connected to the curved structure through the second connecting plate.

As shown in FIGS. 5 and 8, the height H1, by which the curved structure (such as, the arc-shaped structure 14 or the M-shaped curved structure 15) protrudes upward from the upper surface of the rigid container floor 10, may be less than the height H by which the blind wave 1 protrudes upward from the top surface of the rigid container floor 10. As a result, it is possible to prevent both ends of the rigid container floor 10 from being higher than the height of the blind wave 1, and avoid blockage that may occur when a cargo enters or leaves the container.

Specifically, the height H from the top point of the blind wave 1 to the upper surface of the rigid container floor 10 is in a range of 3 to 15 mm. Preferably, the height H for the blind wave 1 is in a range of 3-10 mm. Further, the optimum height H for the blind wave 1 is in a range of 6 to 8 mm. By defining the height of the blind wave 1, a lightweight container body can be obtained with improved strength of the rigid container floor 10. Also, while not only it is skid-proof, there will be less debris accumulated in between the blind waves, largely reducing cleanup need.

Various parts of the rigid container floor 10 assembly may be molded in a number of ways. For example, the blind wave 1 may be molded integrally with the wave connecting plate, or the blind wave 1, the wave connecting plates, and the flat portions of the rigid container floor 10 are molded integrally. Such a construction allows for a rigid container floor 10 of even better strength.

The rigid container floor 10, the blind wave 1 and the wave connecting plate can be made of materials such as carbon steel, aluminum, stainless steel or complex steel plate (a complex steel plate may have carbon steel at one side and stainless steel at the other side) or similar rigid materials with certain strength, stiffness and tensile properties. Hence, the resulting strength of the rigid container floor 10, the blind wave 1 and the wave connecting plate is increased.

The present invention also discloses a container comprising the above rigid container floor 10. Alternatively, the container further comprises a bottom frame (not shown in Figs.). Since the second edge part 162 of the rigid container floor 10 is provided with no blind wave, that is, the second edge part 162 is a flat plate or a curved structure, it is thus possible to connect, at the second edge part 162 of the rigid container floor 10, the rigid container floor 10 to this bottom frame by welding, riveting or screw or other manners. Therefore, the task difficulty is depressed and the production efficiency is improved, and it's possible to carry out an automatically and continuously welding.

The present invention has been described with the above embodiments thereof, however, it should be appreciated that the above embodiments are used only for the purpose of illustration and explanation, rather than limiting the present invention within the scope of the described embodiments. Furthermore, the skilled in this art would understand that the present invention is not restricted to the above embodiments; the teaching according to the present invention can also be altered and modified in various ways, all of which fall into the protective scope claimed by the present invention.

What is claimed is:

1. A rigid container floor, wherein the rigid container floor is provided thereon in parallel with a plurality of blind waves protruding upward from the upper surface of the rigid container floor, the blind wave comprises two parallel first sides and two parallel second sides with the length of each of the first sides being greater than that of the second sides, wherein each of the two first sides are perpendicular to each of the two second sides, wherein each of the two second sides terminates each of the two first sides, wherein each of the two second sides slopes down to contact the floor, and a part of the rigid container floor between the first sides of the adjacent blind waves and a part of the rigid container floor between each of the first side of the blind wave and a first edge of the rigid container floor are flat plate structures, wherein the flat plate structures are connected to the blind waves through wave connecting plates, and a part of the rigid container floor between each of the second sides of the blind wave and a second edge of the rigid container floor is connected to the blind wave through the wave connecting plate.

2. The rigid container floor according to claim 1, wherein the part of the rigid container floor between the second sides of the blind waves and the second edge of the rigid container floor is a flat plate structure connected to the blind waves through the wave connecting plate.

3. The rigid container floor according to claim 2, wherein the wave connecting plate comprises a first connecting plate and a second connecting plate, the first side of the blind wave is connected to the flat plate structure through the first connecting plate, and the second side of the blind wave is connected to the flat plate structure through the second connecting plate.

4. The rigid container floor according to claim 1, wherein the part of the rigid container floor between the second sides of the blind waves and the second edge of the rigid container floor is a curved structure connected to the blind waves through the wave connecting plate.

5. The rigid container floor according to claim 4, wherein the curved structure is arc-shaped or M-shaped.

6. The rigid container floor according to claim 4, wherein the wave connecting plate comprises a first connecting plate and a second connecting plate, the first side of the blind wave is connected to the flat plate structure through the first connecting plate, and the second side of the blind wave is connected to the curved structure through the second connecting plate.

7. The rigid container floor according to claim 4, wherein the height, by which the curved structure protrudes upward from the upper surface of the rigid container floor, is less than the height, by which the blind wave protrudes upward from the upper surface of the rigid container floor.

8. The rigid container floor according to claim 1, wherein the rigid container floor is molded integrally.

9. The rigid container floor according to claim 1, wherein the blind wave is provided along the length direction of the rigid container floor.

10. The rigid container floor according to claim 1, wherein the blind wave protrudes upward from the upper surface of the rigid container floor by a height of 3 to 15 mm.

11. The rigid container floor according to claim 10, wherein the height of the blind wave is 3 to 10 mm.

12. The rigid container floor according to claim 11, wherein the height of the blind wave is 6 to 8 mm.

13. The rigid container floor according to claim 1, wherein the blind wave is in a runway-shape or rectangular.

14. A container comprising a rigid container floor, wherein the rigid container floor is provided thereon in parallel with a plurality of blind waves protruding upward from the upper surface of the rigid container floor, the blind wave comprises two parallel first sides and two parallel second sides with the length of each of the first sides being greater than that of the second sides, wherein each of the two first sides are perpendicular to each of the two second sides, wherein each of the two second sides terminates each of the two first sides, wherein each of the two second sides slopes down to contact the floor, and a part of the rigid container floor between the first sides of the adjacent blind waves and a part of the rigid container floor between each of the first side of the blind wave and a first edge of the rigid container floor are flat plate structures, the flat plate structures are connected to the blind waves through wave connecting plates, and a part of the rigid container floor between each of the second sides of the blind wave and a second edge of the rigid container floor is connected to the blind wave through the wave connecting plate.

15. The container according to claim 14, wherein the part of the rigid container floor between the second sides of the blind waves and the second edge of the rigid container floor is a flat plate structure connected to the blind waves through the wave connecting plate.

16. The container according to claim 14, wherein the part of the rigid container floor between the second sides of the blind waves and the second edge of the rigid container floor is a curved structure connected to the blind waves through the wave connecting plate.

17. The container according to claim 14, wherein the rigid container floor is molded integrally.

18. The container according to claim 14, wherein the blind wave is provided along the length direction of the rigid container floor.

19. The container according to claim 14, wherein the blind wave protrudes upward from the upper surface of the rigid container floor by a height of 3 to 15 mm.

20. The container according to claim 14, wherein the container further comprises a bottom frame, and the rigid container floor is welded, riveted or screwed to the bottom frame.

* * * * *